United States Patent [19]

Massarsch

[11] Patent Number: 4,685,835

[45] Date of Patent: Aug. 11, 1987

[54] METHOD OF INCREASING THE COMPRESSIBILITY OF LIQUID-SATURATED MATERIAL

[75] Inventor: Karl Massarsch, La Hulpe, Belgium

[73] Assignee: S.A. Compagnie Internationale des Pieux Armes Frankignoul, Liege, Belgium

[21] Appl. No.: 785,450

[22] Filed: Oct. 8, 1985

[30] Foreign Application Priority Data

Oct. 19, 1984 [SE] Sweden ..... 8405249

[51] Int. Cl.[4] ..... E02D 3/12

[52] U.S. Cl. ..... 405/263; 405/258

[58] Field of Search ..... 405/229, 258, 263–267, 405/270; 523/130–132; 52/167, 169.5, 169.14, 742; 106/900

[56] References Cited

U.S. PATENT DOCUMENTS

| | | | |
|---|---|---|---|
| 159,805 | 2/1975 | Dobbs | 405/263 X |
| 3,110,129 | 11/1963 | Baumann | 405/263 X |
| 3,306,355 | 2/1967 | Maly | 405/264 X |
| 3,593,799 | 7/1971 | Boughton et al. | 405/263 X |
| 3,847,722 | 11/1974 | Kistner | 405/264 X |
| 4,114,382 | 9/1978 | Kubens et al. | 405/264 |
| 4,133,179 | 1/1979 | Kawasaki et al. | 405/263 |
| 4,191,496 | 3/1980 | Becker | 405/229 |
| 4,209,568 | 6/1980 | Clem | 405/263 X |

*Primary Examiner*—Andrew V. Kundrat
*Assistant Examiner*—Nancy J. Stodola

[57] ABSTRACT

The compressibility of liquid-saturated soils is increased by mixing the soil with gas-filled, compressible bodies thus changing the dynamic property of the soil to mitigate against pressure changes therein.

10 Claims, 4 Drawing Figures

METHOD OF INCREASING THE COMPRESSIBILITY OF LIQUID-SATURATED MATERIAL

Figure 1:
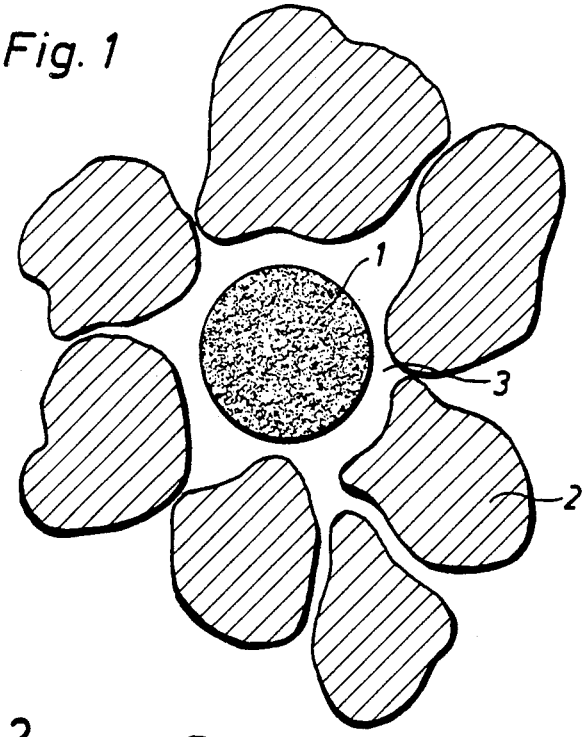

The present invention relates to a method of increasing the compressibility of material saturated with a liquid.

It is already known to utilise the compressibility of gases for the purpose of isolating vibration. In a described method, one or more gas-filled diaphragms are pushed down vertically into the soil strata. In its simplest form the diaphragm consists of an air-filled container made from a suitable elastic material. One or more such containers may be coupled to each other to form a longer cohesive diaphragm unit. The method and apparatus are exhaustively described in the Swedish patent specification No. 8202478-7 (publication number 430.620, E No. 04B 1/98).

It is also known to use gas-filled spheres for vibration isolation purposes, apart from the diaphragm just mentioned. The method that has so far been dominating in arranging spheres below ground level is to arrange such spheres tightly against each other in a ditch, or excavated trench, round the building or buildings which are to be insulated against vibration. This method is described, inter alia, in SU No. 626.154.

Both methods described function well when it is a question of isolating buildings from vibrations in the soil. However, the compressibility of the soil strata is not changed, and the diaghragm and spheres serve as local vibration isolating curtains. Stated differently, the prior art made no attempt to modify the soil properties for safeguarding buildings constructed in liquid saturated soil. The present invention deviates from the prior art approach by modifying the dynamic properties of the soil in the region of building foundations by increasing the compressibility of the soil as more fully hereinafter disclosed.

More specifically, I have found that in soil strata saturated by water it is desirable to modify the soil properties by changing to change the compressibility of the material, and thus its dynamic properties. Resonance effects between soil strata and building structure may thus be avoided, as well as preventing the occurrance of the "liquefaction phenomenon", which results in a dramatic loss of strength of the foundation material.

Trials have shown that the compressibility of saturated soils can be changed as soon as even small amounts of gas have been built up in the system.

Thus, for example, reducing soil layer from 100% to 99% water saturation by, for example injecting compressible filled bodies into the soil to change the dynamic properties of the soil entirely. This effect can be used to modify the dynamic behaviour of e.g. machine foundations. The tendency of the material to flow, e.g. during earthquakes or as a result of wave action, may thus be prevented. Soil strata that have a great tendency to flow are liquid-saturated silts, sand and gravel, i.e. so-called frictional soils.

The problem mentioned above is solved by the method according to the invention, wherein gas-filled spheres, cushions or similar bodies are installed, injected, infiltrated or mixed with the partially or entirely water-saturated soil strata. By installing, injecting or mixing gas-filled compressibile bodies in the soil strata over large areas and down to considerable depth, the dynamic properties of the liquid-saturated material are changed so that pressure variations occurring in the soil may be mitigated. It can be important in some cases for the function of the bodies filled with medium that the pressure in them can be adjusted to the external soil and liquid pressures. In certain cases it may therefore be suitable to have an increased pressure in them when they are installed, for balancing the ambient soil or liquid pressure at the level they are intended for. Furthermore, the gas-filled compressible bodies will be compressed when slow (static) pressure changes occur in the soil strata, e.g. due to soil loading or freezing of the soil. In such a case, the bodies will have pressure-mitigating properties. For the bodies to remain in the soil strata without wandering upwards or sideways, when the ground is subjected to vibrations or the flow of water, it is important that the dimensions of the bodies are adjusted to the type of soil that is to be stabilized. In certain cases it is an advantage for the size of the bodies to be of the comparatively same size as the individual particles or pores. To further increase the anchoring capacity of the bodies, they may be combined, within the scope of the invention, with a binder such as plastics foam, e.g. polyurethane, bentonite or other suitable material. The binder will also reduce the gas diffusion from the pressurised bodies.

The characterizing features of the invention are apparent from the accompanying claims.

Figure 2:
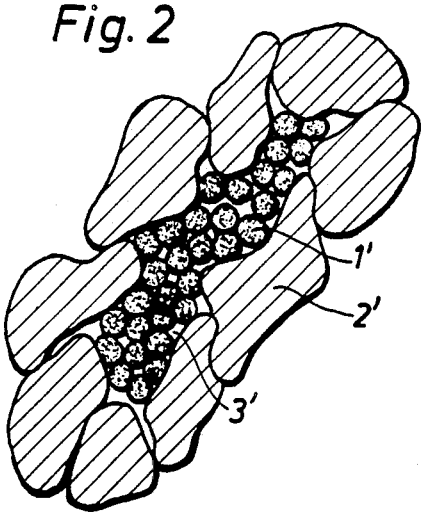
Figure 3:
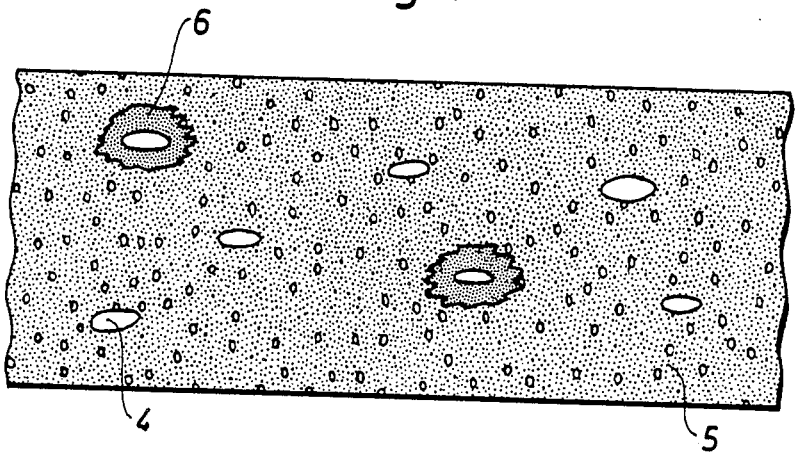
Figure 4:
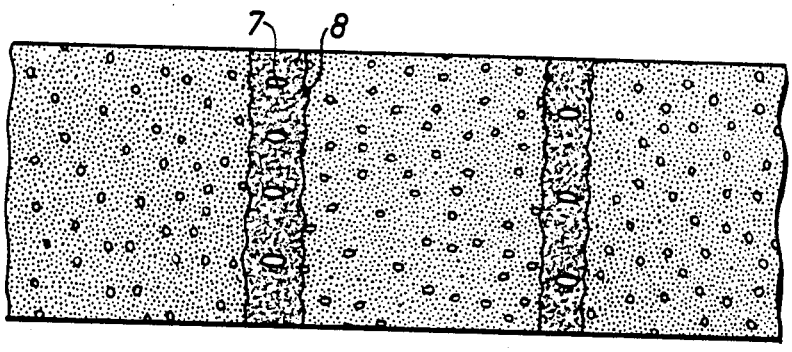

The invention will now be described with reference to the accompanying drawings, on which FIG. 1 illustrates a spherical body together with surrounding soil particles, FIG. 2 illustrates spherical bodies lying close together, with surrounding soil particles, FIG. 3 illustrates the bodies arranged in a soil stratum, and FIG. 4 illustrates an alternative arrangement of the bodies in a soil stratum.

The term "sphere" will be used hereinafter, although bodies with other geometric configurations could be used. One or more spheres 1 with surrounding soil particles 2 are illustrated schematically in the figures. In FIG. 1 the size of the sphere 1 is roughly the same size as the individual soil particles. Greater or less amounts of water 3 are to be found between the spheres and particles. In FIG. 2 a plurality of spheres 1' with smaller dimensions has been injected into the soil stratum. These will thus fill out better the liquid-filled cavity 3' between the soil particles 2', and decrease the percentage of water-saturated material. A soil stratum built up in this way, alternatingly from soil particles and gas-filled spheres according to FIGS. 1 and 2, substantially increases the compressibility of the material. Injection of the gas-filled spheres may take place with the help of nozzles thrust into the ground, the spheres being pressed out into the soil at different levels. Mixing or placement of the spheres may also conceivably take place by mechanical tools or in conjunction with some ground vibration technique, electroosmosis or other suitable method. For ensuring that the spheres remain at the desired level they may be provided with a binder, e.g. bentonite, foam or the like. The spheres can also be placed in excavated trenches or boreholes. When refilling after excavation, the fill may be mixed with gasfilled spheres in conjunction with the actual filling process.

The bodies may also be formed and arranged as illustrated in FIGS. 3 and 4. In FIG. 3, bodies 4 filled with medium may be arranged in a soil fill generally denoted by 5. As will be seen from the Figure, one or more of the bodies may be combined with another material 6, e.g. a plastics foam, bentonite or the like, thus to improve the anchoring capacity of the bodies so that they do not migrate in the soil stratum. The bodies filled with medium illustrated in FIG. 4 are arranged in one or more pre-excavated holes or trenches 8 made to a suitable depth, and surrounded by soil, binder or a combination thereof.

It is also possible to mix sludge or mine tailings with gas-filled, compressible bodies so that these products, when they are together with water, for example, are sprayed out and stored in sludge or tailings dams, are given a dynamic stability such that the risk of sliding is reduced due to the increase in compressibility.

The method accounted for above for increasing the compressibility of water-saturated material can of course be modified without departing from the inventive concept. Liquids other than water may thus be envisaged. The invention shall therefore not be considered as being restricted to the methods set forth above, but may be varied within the scope of the appended claims.

What is claimed is:

1. Method of increasing the compressibility of a material in vicinity of building foundations where the material is saturated by a liquid to a predetermined degree and comprising changing the degree of liquid saturation of said material by incorporating discrete compressible bodies, filled with a medium, to a predetermined depth within said material in the vicinity of said building foundations, said discrete bodies being such as to reduce diffusion of said medium into said material.

2. Method of increasing the compressibility of a material saturated by a liquid to a predetermined degree and comprising changing the degree of liquid saturation of said material by incorporating within said material compressible bodies filled with a medium, said compressible bodies being such as to reduce diffusion of said medium into said material.

3. Method as claimed in claim 1 or 2, wherein said bodies are mixed with or placed in the material.

4. Method as claimed in claim 1 or 2, wherein the medium is a gas and said material is soil.

5. Method as claimed in claim 1 or 2, wherein the medium is a foam.

6. Method as claimed in claim 1 or 2, wherein the medium in said bodies is at a pressure adjusted to that of the liquid saturated material.

7. Method as claimed in claim 1 or 2, wherein said bodies are provided with a surrounding anchoring agent.

8. Method as claimed in claim 7, wherein said agent is a foam material.

9. Method as claimed in claim 7, wherein said agent is bentonite.

10. Method as claimed in claim 7, wherein said agent is of a material restricting diffusion of said medium comprising a gas from the bodies into the material.

* * * * *